US008251480B2

(12) United States Patent
Moriyama et al.

(10) Patent No.: US 8,251,480 B2
(45) Date of Patent: Aug. 28, 2012

(54) INK JET PRINTING APPARATUS

(75) Inventors: Jiro Moriyama, Kawasaki (JP); Masashi Hayashi, Sagamihara (JP); Yuji Konno, Kawasaki (JP); Takeshi Yazawa, Yokohama (JP); Kiichiro Takahashi, Yokohama (JP); Yoshiaki Murayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 399 days.

(21) Appl. No.: 12/481,276

(22) Filed: Jun. 9, 2009

(65) Prior Publication Data

US 2009/0315934 A1 Dec. 24, 2009

(30) Foreign Application Priority Data

Jun. 20, 2008 (JP) ..... 2008-161758

(51) Int. Cl.
*B41J 29/38* (2006.01)
*B41J 23/00* (2006.01)
*B41J 2/01* (2006.01)

(52) U.S. Cl. ..... 347/16; 347/37; 347/104

(58) Field of Classification Search ..... 347/37
See application file for complete search history.

(56) References Cited

U.S. PATENT DOCUMENTS 5,019,840 A 5/1991 Watanabe et al.
5,130,726 A 7/1992 Fukushima et al.
5,771,050 A * 6/1998 Gielen ..... 347/37
5,936,651 A 8/1999 Uchida et al.
5,943,081 A 8/1999 Uchida et al.
6,116,728 A 9/2000 Miyake et al.
6,168,261 B1 1/2001 Miyake et al.
6,174,039 B1 1/2001 Miyake et al.
6,264,305 B1 7/2001 Inui et al.
6,359,695 B1 3/2002 Takahashi et al.
6,398,358 B1 6/2002 Miyake et al.
6,478,405 B2 * 11/2002 Boerstal et al. ..... 347/43
6,490,053 B1 12/2002 Takahashi et al.
6,543,892 B2 4/2003 Kubota et al.
6,712,443 B2 3/2004 Kanda et al.
6,764,154 B2 7/2004 Nishikori et al.
6,767,074 B2 * 7/2004 Usui et al. ..... 347/37
6,991,316 B2 1/2006 Maru et al.
6,997,541 B2 2/2006 Edamura et al.

(Continued)

FOREIGN PATENT DOCUMENTS

JP 2002361958 A * 12/2002

(Continued)

*Primary Examiner* — Shelby Fidler
(74) *Attorney, Agent, or Firm* — Fitzpatrick, Cella, Harper & Scinto

(57) ABSTRACT

An ink jet printing apparatus printing on a print medium includes a print head having a plurality of ejection ports for ejecting ink while scanning in a scan direction, and a conveyance unit including a pair of rollers for conveying the print medium in a conveyance direction crossing the scan direction by rotation of the rollers. The rollers are provided at a position at an upper stream side in the conveying direction of the print medium from a print position at which printing by the print head is performed. A detection unit is configured to detect a downstream side end of the print medium conveyed by the pair of rollers, with the detection unit arranged at a position that is a distance from the pair of rollers, in the conveyance direction, corresponding to a length of the print medium. In addition, a change unit is configured to change the ejection ports available for printing according to an error in conveyance detected by the detection unit.

5 Claims, 8 Drawing Sheets

U.S. PATENT DOCUMENTS

| | | | | |
|---|---|---|---|---|
| 7,114,790 | B2 | 10/2006 | Seki et al. | |
| 7,258,429 | B2 | 8/2007 | Takahashi et al. | |
| 7,296,872 | B2 | 11/2007 | Hayashi et al. | |
| 7,315,393 | B2 | 1/2008 | Kanda et al. | |
| 7,325,900 | B2 | 2/2008 | Hayashi et al. | |
| 7,344,219 | B2 | 3/2008 | Sakamoto et al. | |
| 7,413,361 | B2 | 8/2008 | Kawaguchi | |
| 7,458,655 | B2 | 12/2008 | Takahashi et al. | |
| 7,500,727 | B2 | 3/2009 | Takahashi | |
| 2006/0044334 | A1 | 3/2006 | Fujita et al. | |
| 2006/0044380 | A1 | 3/2006 | Yazawa et al. | |
| 2006/0066651 | A1 * | 3/2006 | Linville et al. | 347/9 |
| 2007/0008361 | A1 | 1/2007 | Kawatoko et al. | |
| 2007/0273720 | A1 | 11/2007 | Yasutani et al. | |
| 2007/0273899 | A1 | 11/2007 | Yazawa et al. | |
| 2008/0143765 | A1 | 6/2008 | Takahashi et al. | |
| 2008/0252675 | A1 | 10/2008 | Yasutani et al. | |
| 2008/0252676 | A1 | 10/2008 | Yasutani et al. | |
| 2008/0252677 | A1 | 10/2008 | Tajika et al. | |
| 2008/0266348 | A1 | 10/2008 | Seki et al. | |
| 2009/0021551 | A1 | 1/2009 | Fletcher et al. | |

FOREIGN PATENT DOCUMENTS

| | | |
|---|---|---|
| JP | 2006-130789 | 5/2006 |

* cited by examiner

INK JET PRINTING APPARATUS

BACKGROUND OF THE INVENTION

1. Field of the Invention

The present invention relates to an ink jet printing apparatus that prints on a print medium being conveyed, and in particular, to an ink jet printing apparatus that deals with a possible variation in the conveyance amount of the print medium caused during conveyance.

2. Description of the Related Art

Ink jet printing apparatuses form images by fixing droplets of ink or the like to the surface of a print medium as a coloring material. There has recently been a growing demand for improvement of the quality of images printed by the ink jet printing apparatus. In connection with the demand, the volume of each droplet ejected by the ink jet printing apparatus has tended to decrease.

The reduced volume of the ejected droplet decreases the diameter of a print dot after impact onto the print medium. Although depending on the bleeding characteristics of the print medium, the diameter of each dot is about 30 μm on print media corresponding to photographic quality. For dots with a smaller diameter, the demand for the accuracy of the impact position on the print medium is higher. If dots of diameter about 30 μm are formed, ejected droplets need to exhibit, as a tolerable error, an impact accuracy of about 15 μm, corresponding to the range of data (the amount between the maximum value and minimum value of the data), in general, though the accuracy may vary depending on peripheral environments and the type of the apparatus.

For the ink jet printing apparatuses of a serial-scan type that print a print medium by allowing a print head to scan the print medium being conveyed, there has been a growing demand for improvement of the impact accuracy of ejected droplets in both a conveyance direction and a direction intersecting with the conveyance direction. Here, the conveyance direction refers to the direction in which the print medium is conveyed. In general, to be conveyed, the print medium is sandwiched between a pair of rollers at least one of which is rotationally driven. The print medium is then conveyed in the conveyance direction.

However, in the configuration in which the print medium is conveyed in the conveyance direction by the rollers, the conveyance amount of the print medium in the conveyance direction may vary. In particular, when the upstream end of the print medium is released from the rollers, the conveyance amount of the print medium may vary. That is, when the print medium is released from the rollers, the amount by which the print medium moves in the conveyance direction may vary. Thus, an image on the printed print medium may include an unprinted area or a particular part of the image may be scanned an unnecessarily large number of times for printing. When a particular part of the image is scanned an unnecessarily large number of times, a black-stripe like-line may be created in that part. This may degrade the quality of images obtained by the printing.

To solve these problems, Japanese Patent Laid-Open No. 2006-130789 proposes an ink jet printing apparatus that reduces the number of ejection ports through which droplets are ejected when a print medium is released from rollers. This reduces the conveyance amount during each scan and thus a possible error in conveyance amount. The reduced conveyance amount during each scan allows the number of scans to be increased. Moreover, when the print medium is released from the rollers, a gear transmitting rotation to the rollers may backlash to excessively convey and thus misalign the print medium. The misalignment of the print medium is absorbed by shifting the range of active ejection ports in the print head to the upstream side.

Variation in the conveyance amount of the print medium can be reduced by using the printing apparatus disclosed in Japanese Patent Laid-Open No. 2006-130789, for printing. However, the ink impact accuracy may still be varied by an error in conveyance amount. Furthermore, Japanese Patent Laid-Open No. 2006-130789 describes the absorption of an error resulting from the misalignment of the print medium in the direction in which the print medium is excessively conveyed by the backlash of the gear transmitting rotation to the rollers. However, the misalignment may occur in the opposite direction. Furthermore, when a print head ejecting smaller droplets in order to further improve the image quality is used for printing, the print dot diameter is also reduced to increase the required impact accuracy. Therefore, a method has been required which further reduces the error in the conveyance of the print medium.

SUMMARY OF THE INVENTION

In view of the above-described circumstances, an object of the present invention is to provide an ink jet printing apparatus that can inhibit the possible degradation of image quality resulting from variation in the conveyance amount of a print medium.

According to a first aspect of the present invention, there is provided an ink jet printing apparatus for printing on a print medium by ejecting ink from a print head having a plurality of ejection ports for ejecting the ink while scanning the print head in a scan direction, the ink jet printing apparatus comprising: a conveyance section configured to convey the print medium in a conveyance direction crossing the scan direction; a detection section configured to detect conveyance amount of the print medium conveyed by the conveyance section; and a change section configured to change the ejection ports available for printing according to an error value for the conveyance amount detected by the detection section.

According to a second aspect of the present invention, there is provided an ink jet printing apparatus for printing on a print medium by ejecting ink from a print head having a plurality of ejection ports for ejecting the ink while scanning the print head in a scan direction, the ink jet printing apparatus comprising: a conveyance section configured to convey the print medium in a conveyance direction crossing the scan direction; a detection section configured to detect conveyance amount of the print medium conveyed by the conveyance section; and a head position adjusting section configured to move the print head in the conveyance direction according to an error value for the conveyance amount detected by the detection section.

According to a third aspect of the present invention, there is provided an ink jet printing apparatus for printing a print medium by ejecting ink from a print head having a plurality of ejection ports for ejecting the ink while scanning the print head in a scan direction, the ink jet printing apparatus comprising: a conveyance section configured to convey the print medium in a conveyance direction crossing the scan direction; a detection section configured to detect conveyance amount of the print medium conveyed by the conveyance section; a change section configured to change the ejection ports available for printing if an error value for the conveyance amount detected by the detection section is greater than a predetermined value; and a head position adjusting section configured to move the print head in the conveyance direction if the error value for the conveyance amount detected by the detection section is equal to or smaller than the predetermined value.

According to the present invention, the position of the print head can be adjusted in association with variation in the conveyance amount of the print medium. Thus, the possible degradation of the image quality resulting from a conveyance variation can be inhibited.

Further features of the present invention will become apparent from the following description of exemplary embodiments (with reference to the attached drawings).

DESCRIPTION OF THE EMBODIMENTS

Embodiments for carrying out the present invention will be described below with reference to the accompanying drawings.

Figure 1:
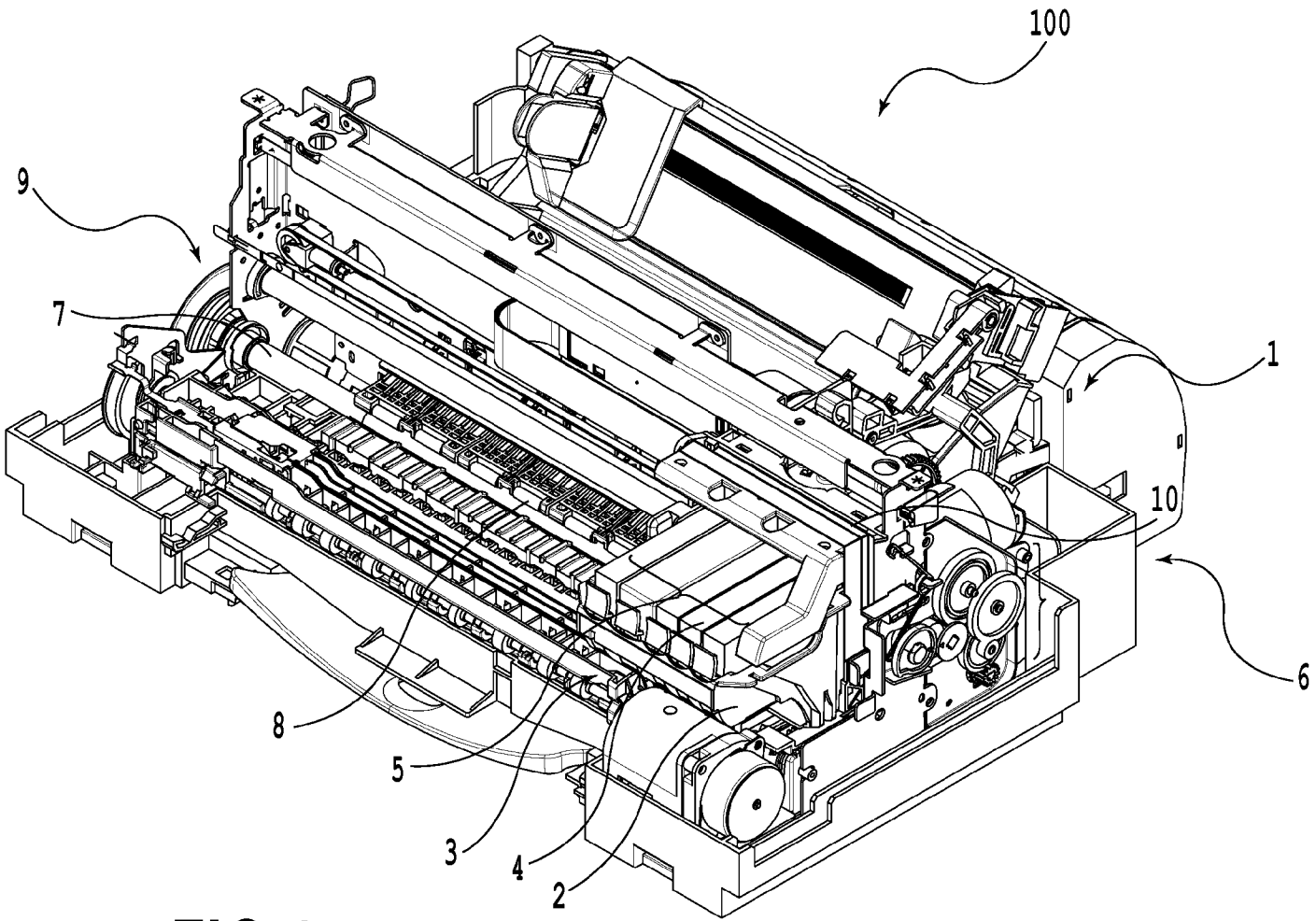
FIG. 1 is a perspective view of an ink jet printing apparatus according to an embodiment of the present invention.
Figure 2A:
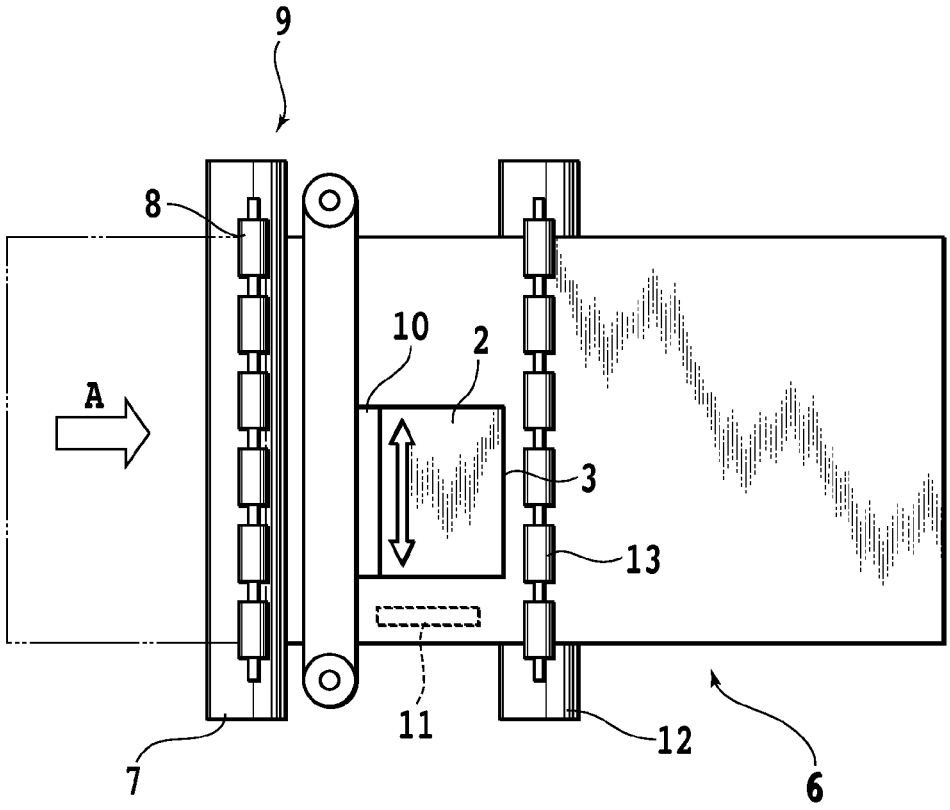
FIG. 2A is a schematic plan view of the ink jet printing apparatus in FIG. 1.
Figure 2B:
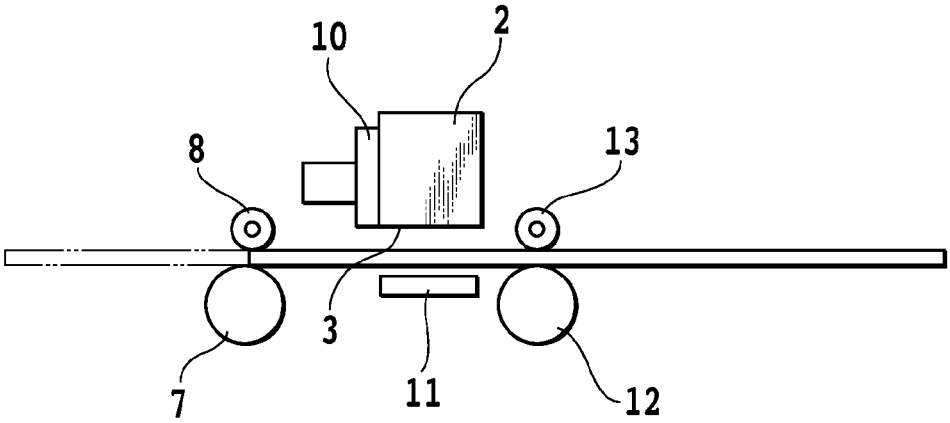
FIG. 2B is a schematic side view of the ink jet printing apparatus in FIG. 1.

The configuration of an ink jet printing apparatus according to an embodiment of the present invention will be described. FIG. 1 is a perspective view of an ink jet printing apparatus 100 according to the present embodiment. FIG. 2A is a plan view schematically showing the ink jet printing apparatus 100 according to the present embodiment. FIG. 2B is a schematic side view of the ink jet printing apparatus 100. An auto sheet feeder (ASF) including a conveyance mechanism that conveys print media and a tray on which print media are placed are attached to the ink jet printing apparatus 100. In the ink jet printing apparatus 100 shown in FIG. 1, a plurality of print media P laid on top of one another are stacked on the tray in the auto sheet feeder 1. The ink jet printing apparatus 100 according to the present embodiment is based on a serial scan scheme. A carriage 2 is mounted in a main body section 6 of the ink jet printing apparatus 100. The carriage 2 is mounted so as to be reciprocatingly movable in a direction intersecting with a conveyance direction by means of a carriage motor and a driving force transmitting mechanism such as a belt which transmits the driving force of the carriage motor. In the present embodiment, the carriage 2 moves particularly in the direction intersecting with the conveyance direction. A plurality of ink jet cartridges for respective colors are mounted on the carriage 2. Each of the ink jet cartridges 5 includes a print head 3 that can eject droplets for printing and an ink tank 4 serving as an ink storage section that supplies ink to the print head 3; the print head 3 and the ink tank 4 are integrally formed. The print head 3 and the ink tank 4 may be separately constructed. In this manner, the carriage 2 with the ink jet cartridges 5 provided thereon is mounted in the main body section 6 of the ink jet printing apparatus 100.

As shown in FIGS. 2A and 2B, an LF (Line Feed) roller 7 and an LF pinch roller 8 are arranged on the upstream side of the print head 3 in the conveyance direction. The LF roller 7 serves as a driving roller that provides rotational driving to convey print media, and the LF pinch roller 8 is located in proximity to the LF roller 7 and serves as a driven roller. The LF roller 7 and the LF pinch roller 8 are arranged in a roller conveying section 9 as a pair of rollers. The roller conveying section 9 conveys a print medium sandwiched between the LF roller 7 and the LF pinch roller 8, the pair of rollers, in a direction intersecting with a scanning direction of the print head 3. In the present embodiment, the roller conveying section 9 is located on the upstream side of the print head 3 in the conveyance direction. When the print medium is sandwiched between the LF roller 7 and the driven roller 8, the LF roller 7 is driven with the print medium remaining sandwiched between the rollers. The print medium is thus conveyed downstream.

A detection section 11 is provided on the downstream side of the roller conveying section 9 at a position corresponding substantially to the print head 3. The detection section 11 detects the conveyance amount of the print medium in the conveyance direction as shown in FIGS. 2A and 2B. In particular, the detection section 11 according to the present embodiment detects the conveyance amount of the print medium when the print medium is released from the roller conveying section 9.

In the present embodiment, a print head position adjusting section 10 is located between the main body portion 6 and carriage 2 in the ink jet printing apparatus 100. The print head position adjusting section 10 functions as a distance adjusting section that can adjust the relative distance between the print head 3 and the main body portion 6 in the conveyance direction. In this manner, the print head 3 is connected to the main body section 6 of the ink jet printing apparatus via the print head position adjusting section 10. Thus, the print head 3 is movable relative to the main body portion 6 in the conveying direction according to an error in the conveyance amount of the print medium detected by the detection section. The head position adjusting section 10 is composed of a piezo element. A voltage is applied to the piezo element to enable the print head to move in the conveyance direction. The minimum moving distance achieved by the head position adjusting section 10 is set to be shorter than the array pitch of ejection ports in the print head. Here, the main body section 6 of the ink jet printing apparatus 100 refers to a part of the ink jet printing apparatus 100 except for the carriage 2 and the print head moving section 10. That is, the main body section 6 refers to the auto sheet feeder 1, the roller conveying section 9, a platen, and the like.

As shown in FIGS. 2A and 2B, the print medium is conveyed from the upstream side of the LF roller 7 and the LF pinch roller 8 and then conveyed in the conveyance direction. In the present embodiment, the print medium is conveyed in the direction of arrow A in FIG. 2A. The conveyance of the print medium and scanning by the print head 3 are repeated, with the print head 3 ejecting ink droplets onto the print medium. Thus, the entire print medium is printed.

The LF roller 7 is rotationally driven to start conveying the print medium sandwiched between the LF roller 7 and the LF pinch roller 8. Then, the print medium is sandwiched between an EJ (EJect) roller 12 and an EJ pinch roller 13. The EJ roller 12 is then driven to convey the print medium to the downstream side. During a printing operation, the print medium is intermittently conveyed. In this case, the required accuracy of the conveyance amount of the print medium is set to a relatively large value.

Figure 3:
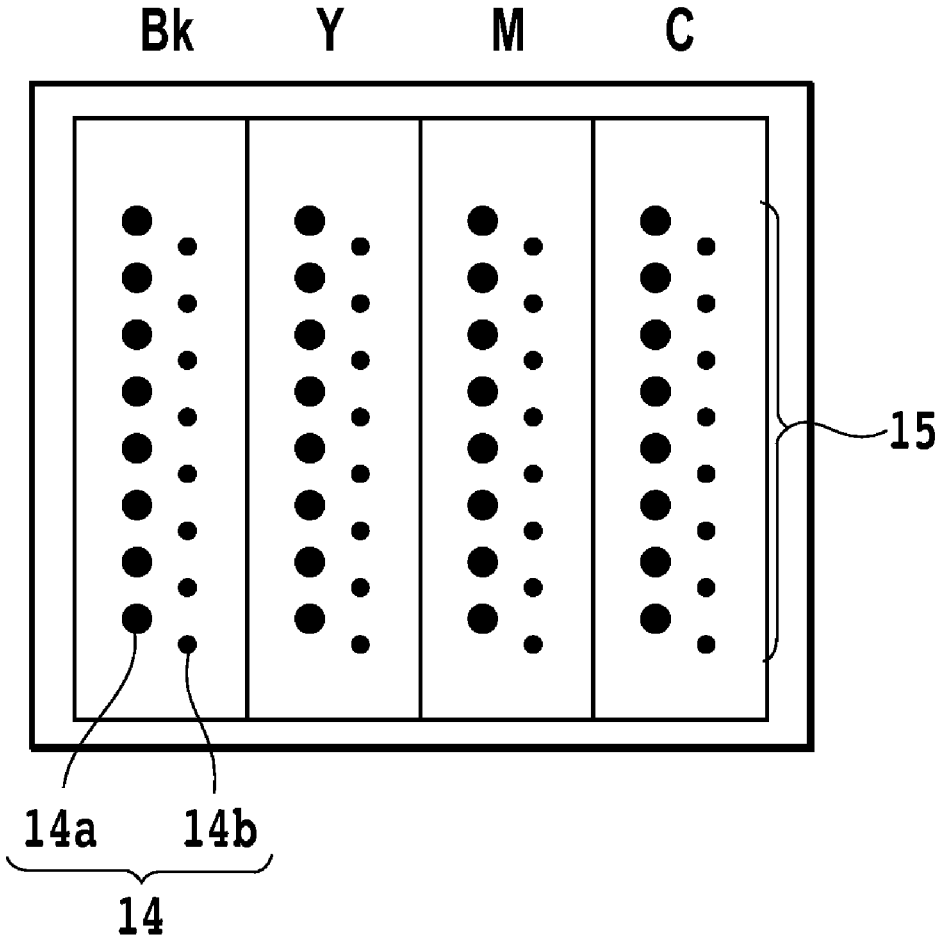
FIG. 3 is a plan view of an ejection port formation surface of a print head used in the ink jet printing apparatus in FIG. 1.

Now, the arrangement and configuration of ejection ports in the print head 3 will be described. FIG. 3 is a schematic plan view showing the arrangement of ejection ports 14 in the print head. The ejection ports 14, through which droplets for printing can be ejected, are formed in the print head 3. In the print head 3 according to the present embodiment, a plurality of the ejection ports are formed in the conveyance direction of the print medium so as to form ejection port rows 15. The ink jet printing apparatus according to the present embodiment prints on the print medium by allowing the print head 3 with the plurality of ejection ports 14 arrayed therein so as to form the ejection port rows 15, to perform scanning in the direction intersecting with the array direction of the plurality of ejection ports 14. In the present embodiment, the print head 3 performs scanning in the direction orthogonal to the array direction of the plurality of ejection ports 14 for printing. In the present embodiment, two ejection port rows are formed for each color. In the ejection port rows for each color, one of the ejection port rows is staggered with respect to the other ejection port row by half a pitch. The ejection port rows are arranged in a checker array. One of the two ejection port rows for each color includes ejection ports 14*a* each having a relatively large diameter. The other ejection port row includes ejection ports 14*b* each having a relatively small diameter. In the present embodiment, 516 ejection ports through each of which 5 pl of ink is ejected and 516 ejection ports from each of which 1 pl of ink is ejected are used for each of four colors, Bk (Black), C (Cyan), M (Magenta), and Y (Yellow). The ejection ports are consecutively arranged at pitches of 2,400 dpi, that is, at intervals of about 11 μm. In the present embodiment, four print heads 3 are used for the respective colors. However, the present invention is not limited to the print heads ejecting four colors. The print heads may eject at least five or at most three types of color ink. Furthermore, a print head ejecting a treatment liquid for treating ink may be used.

The present embodiment uses the serial-scan ink jet printing apparatus in which the print heads 3 are mounted in the main body section so as to be movable in the scanning direction as shown in FIG. 2A. The ink jet printing apparatus prints on the print medium by ejecting droplets to the print medium through the ejection ports to stick the droplets onto the print medium, while conveying the print medium in the conveyance direction.

The print head according to the present embodiment has a maximum print width of 516/2,400=0.215 inches. For printing, 512 consecutive ones of the 516 ejection ports (nozzles) are selectively used. In this case, the print width is 512/2,400=0.213 inches, about 5.4 mm. If the printing to the same region by four passes scanning is carried out at this print width, the print medium is moved in the conveyance direction by about 1.35 mm during each pass.

Standby ejection ports are formed at least at one end in the conveyance direction of the ejection port row 15 in the print head 3. The standby ejection ports are used and droplets are ejected through the standby ejection port only when the print medium is released from the roller conveying section 9. Other than in the time at which the print medium is released from the roller conveying section 9, the droplets are not ejected through the standby ejection port. According to the print head 3 of the present embodiment, when the print medium is released from the roller conveying section 9, droplets are ejected through the standby ejection ports according to the conveyance amount of the print medium in the conveyance direction detected by the detection section. The range of ejection ports through which droplets are ejected for printing is changed.

Before description of printing performed by the ink jet printing apparatus according to the present embodiment, description will be given of the results of measurement of variation in the conveyance amount of the print medium exiting the LF roller in an ink jet printing apparatus in a comparative example for which the present invention is not adopted. In the comparative example, as is the case with the ink jet printing apparatus according to the embodiment, the conveyance amount of the print medium during each scan is set to correspond to a conveyance amount of 1.35 mm except for the period when the print medium is released from the LF roller. When the standard deviation of the conveyance amount of the print medium exiting the LF roller is defined as σ, the actual measured values of the conveyance amount are distributed such that a value corresponding to a region of 3σ centered at the average value is 17 μm. In this manner, variation in actual measured value involves a value being outside of 15 μm as a range of required accuracy for the ink jet printing apparatus.

Figure 4:
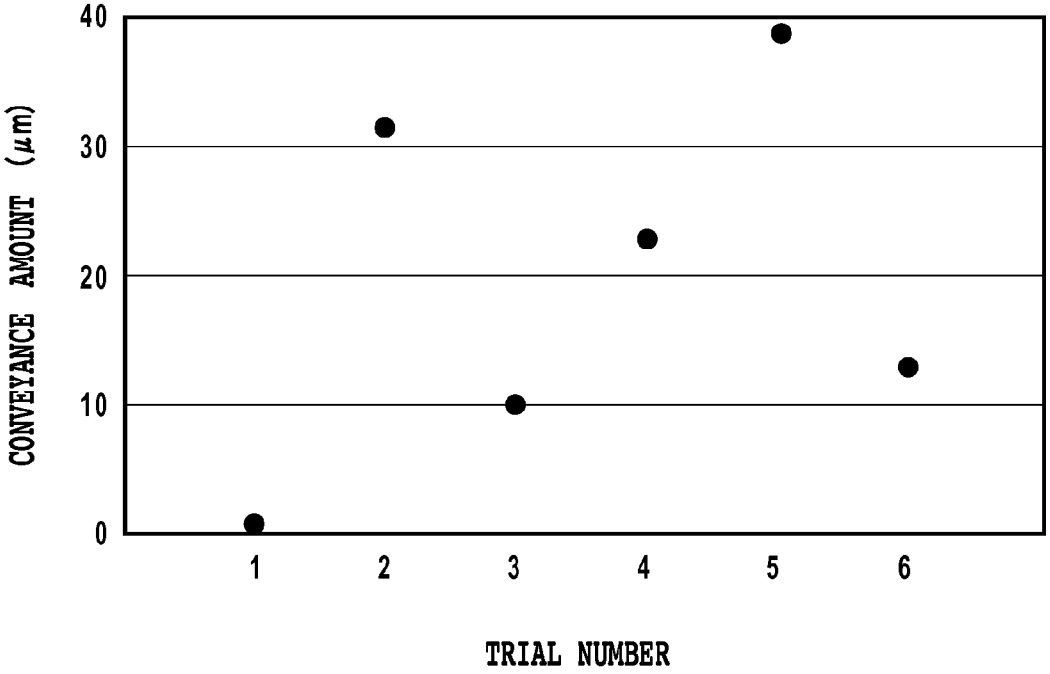
FIG. 4 is a graph showing variation in the conveyance amount of a print medium in an ink jet printing apparatus in a comparative example which variation is observed when the print medium passes between rollers.

FIG. 4 shows the distribution of data obtained when variation in conveyance amount was measured at the moment when the print medium is released from between the LF roller and the LF pinch roller. The number of trials is six. The axis of abscissa shows a trial number. The axis of ordinate shows the conveyance amount. The conveyance amount is distributed over the range of 1 to 39 μm and is not constant. The accuracy required for printing apparatuses as described above and corresponding to the range of at most 15 μm is not met.

The error in the conveyance amount of the print medium in the conveyance direction is greatest at the moment when the print medium is released from between the LF roller and the LF pinch roller. At this time, the conveyance amount of the print medium in the conveyance direction is likely to vary. This is because the print medium conveyed while being sandwiched between the two rollers under a constant pressure jumps to the downstream side at the moment when the print medium is released from between the rollers. Thus, it is considered that the conveyance amount at the moment when the print medium is released from between the rollers can't be controlled. This phenomenon occurs at the position where the upstream-side end of the print medium is released from the LF roller. Even a large conveyance amount can be dealt with provided that the conveyance amount is constant. However, the conveyance amount varies with the conveyance of a print medium each time and thus conventionally fails to be dealt with.

As described above, the ink jet printing apparatus in the comparative example may fail to deal with variation in conveyance amount and to meet the accuracy of the conveyance amount required in the ink jet printing apparatus. Thus, an image resulting from printing may have an unprinted area or black-stripe like-lines caused by printing overlap. This degrades the quality of the image.

In contrast, the ink jet printing apparatuses 100 to which the present invention is applied includes a sensor that detects the moving distance of the print medium as shown in FIGS. 1, 2A, and 2B. The sensor thus detects the conveyance amount of the print medium in the conveyance direction. Then, based on the detected conveyance amount of the print medium, the range of active ejection ports (available ejection ports) 14 in the ejection port row 15 in the print head 3 is shifted (changed). Thus, the present embodiment has a change section which, if the conveyance amount detected by the detection section 11 has an error greater than a predetermined value, shifts (changes) the range of ejection ports available for printing according to the error value. Thus, if the moving distance of the print medium varies relatively significantly, the range of the active ejection ports 14 is shifted to adjust the impact position on the print medium. For such a relatively insignificant variation in conveyance amount as cannot be dealt with simply by shifting the range of the active ejection ports 14, the print head 3 is moved relative to the main body section 6 in the conveyance direction to adjust the impact position of droplets ejected by the print head 3. In this manner, with regard to the adjustment of a relatively small print area, the print head 3 is moved to adjust the impact position. This enables droplets to accurately impact the print medium for printing. As a result, high-quality printing can be achieved.

Figure 5:
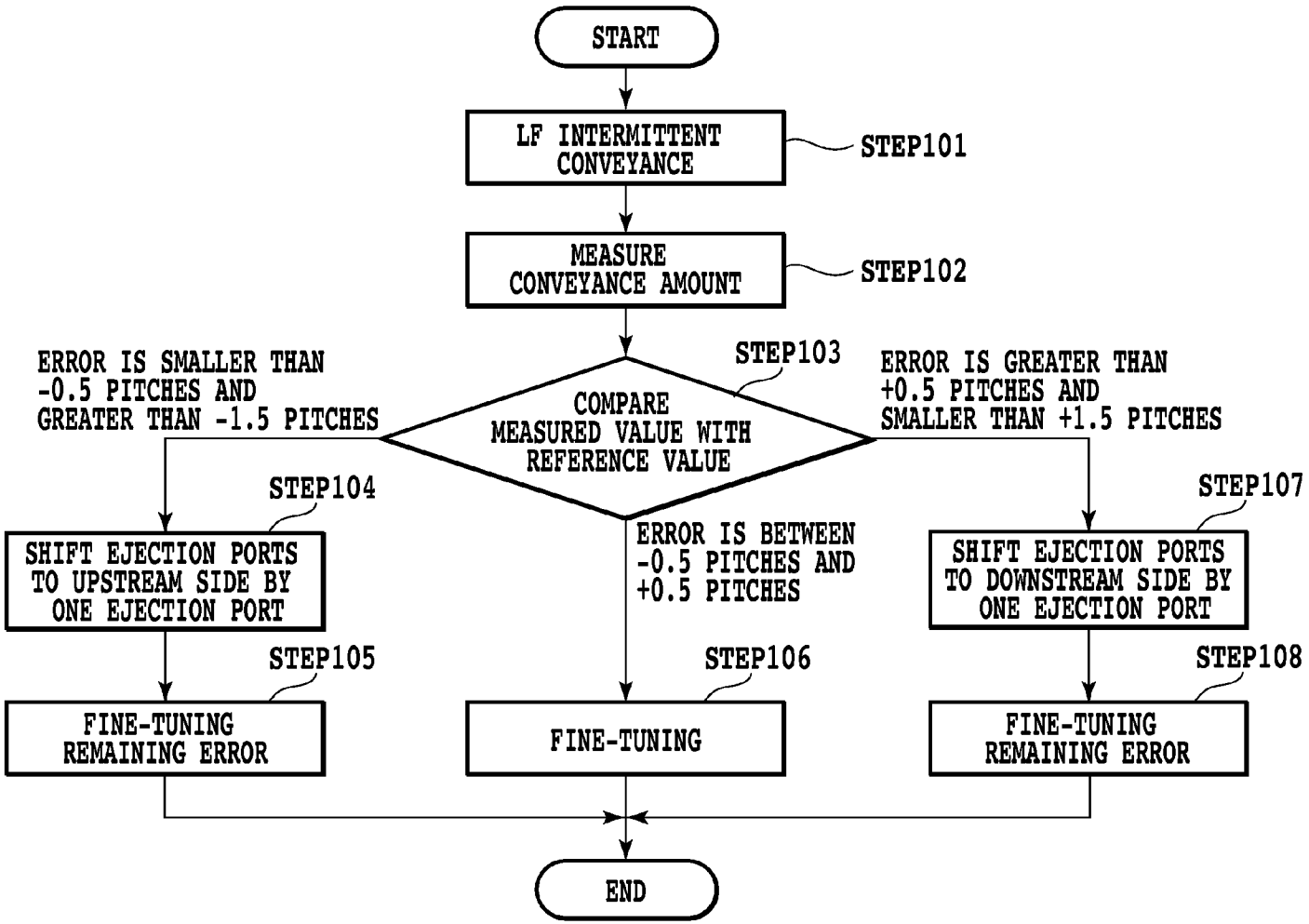
FIG. 5 is a flowchart showing a control process carried out to correct the misalignment of a print area caused by variation in conveyance amount in the ink jet printing apparatus in FIG. 1.

FIG. 5 is a flowchart of control for correcting the misalignment of the print area caused by variation in conveyance amount when the print medium is intermittently conveyed for multipass printing with four passes by driving the LF roller 7. The error amount is assumed to be within the range of −1.5 pitches to −1.5 pitches with respect to a reference value. One pitch in the ejection port row 15 is about 11 μm.

In an operation of conveying the print medium, first, in STEP 101, the print medium is intermittently conveyed by driving the LF roller 7. Then, in STEP 102, the detection section measures and detects the conveyance amount as the actual conveyance amount of the print medium in the conveyance direction (detection step). In STEP 103, the measured value is compared with a target value to calculate a difference (error). Based on the result, the flow branches. If the error value resulting from the difference is smaller than −0.5 pitches and greater than −1.5 pitches, the flow proceeds to STEP 104. Then, according to the error value of the conveyance amount of the print medium detected by the detection section, droplets are ejected through the standby ejection ports 16. At the same time, the ejection of droplets from some of the ejection ports 21 other than the standby ejection ports is halted. In this manner, the range of ejection ports in the ejection port row 15 which are available printing is shifted with respect to the conveyance direction. In the present embodiment, the range of ejection ports in the print head 3 which are used for printing are shifted to the upstream side by one ejection port. The predetermined values for the error are set to 0.5 pitches and 1.5 pitches. If the absolute value of the error is greater than 0.5 pitches and smaller than 1.5 pitches, the range of the active ejection ports is accordingly shifted by one ejection port. In this manner, when the error in conveyance amount based on the conveyance amount of the print medium in the conveyance direction detected in STEP 103 as a detection step is greater than the predetermined value, the ejection ports used for printing is shifted according to the error value (active-ejection-port control step). In the present embodiment, the absolute value of the error is compared with the predetermined value so that the range of the active ejection ports can accordingly be shifted. For a part of the error which fails to be covered in STEP 104 as an active-ejection-port control step, the corresponding remaining amount is further fine-tuned in STEP 105. The fine-tuning will be described below.

When the measured value of the conveyance amount of the print medium is compared with the reference value, if the measured value is greater than +0.5 pitches and smaller than +1.5 pitches compared to the reference value, the flow proceeds to STEP 107. Thus, the range of the ejection ports in the ejection port row in the print head which are used for printing is shifted to the downstream side by one ejection port in STEP 107 as an active-ejection-port control step. A remaining amount of the error is fine-tuned in STEP 108.

On the other hand, if the difference (the error value for the conveyance amount) between the measured value obtained in STEP 103 and the reference value is equal to or smaller than the predetermined value, that is, the difference is within the range of −0.5 pitches to +0.5 pitches, the process proceeds to STEP 106. In STEP 106, only the adjustment by the piezo element is carried out without shifting the range of the ejection ports. In the present embodiment, if the absolute value of the error is equal to or smaller than 0.5 pitches (equal to or smaller than the predetermined value), the shifting of the range of the ejection ports by the active-ejection-port control means is avoided.

In the present embodiment, a control program serving as the active-ejection-port control means is stored in a CPU that controls the ink jet printing apparatus 100 as a whole; the active-ejection-port control means shifts the range of the ejection ports used for printing according to the value of the error in the conveyance amount of the print medium. The present invention is not limited to this aspect. The control program as the active-ejection-port control means may be stored in another storage section such as a ROM, a RAM, or the like.

Figure 6:
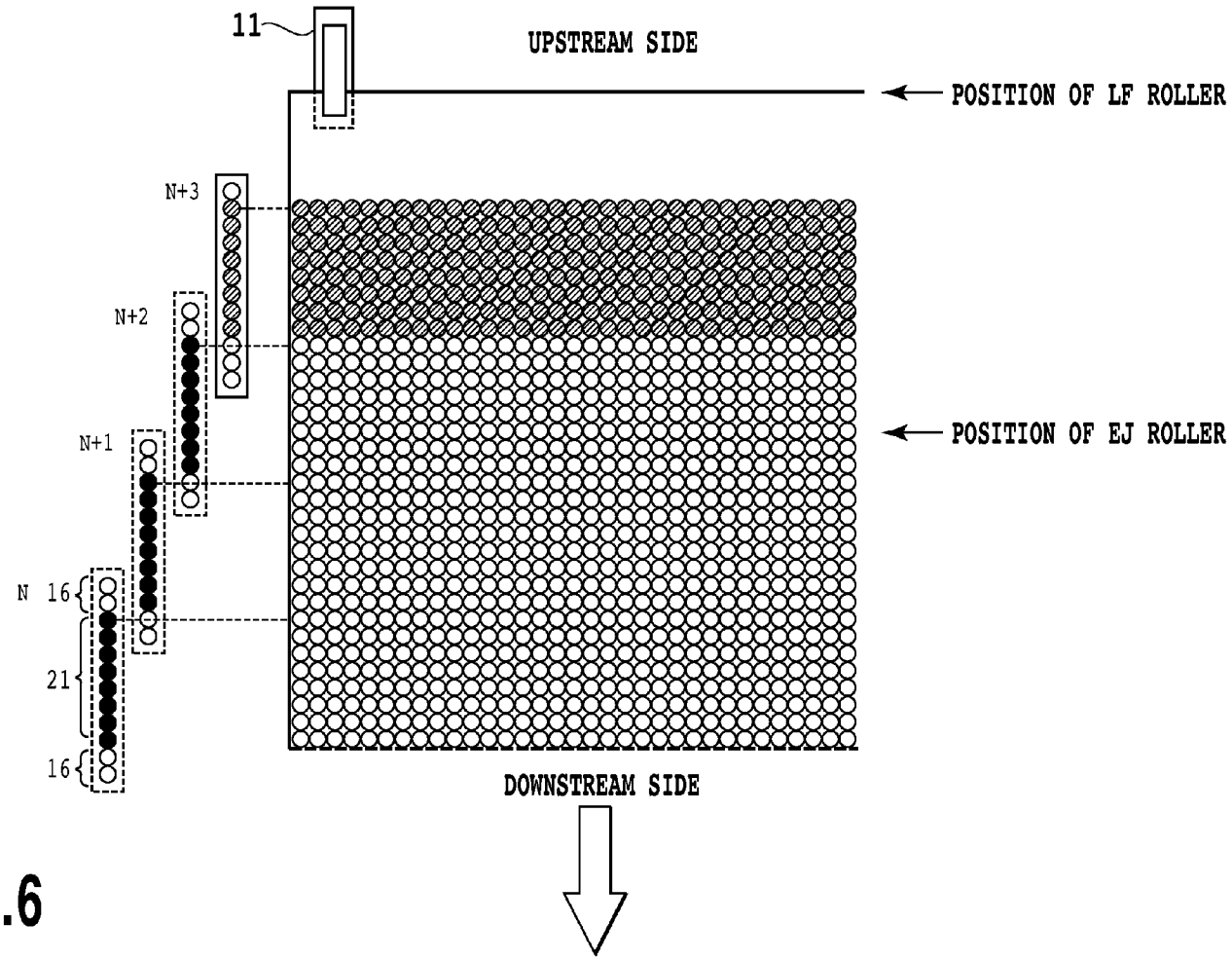
FIG. 6 is a diagram illustrating the range of active ejection ports which is shifted in association with variation in conveyance amount in the ink jet printing apparatus in FIG. 1.

Here, the change of the active ejection ports according to the conveyance amount when the print medium is released from the LF roller will be described with reference to FIG. 6. In the present embodiment, printing is performed by single pass printing of scan. FIG. 6 is a diagram illustrating the print head in which the range of the active ejection ports is changed according to the conveyance amount when the print medium is released from the LF roller.

The print medium is intermittently conveyed from the upstream side to the downstream side, for example, from the top to bottom of FIG. 6. White circles in the print medium show already printed positions. FIG. 6 shows ejection ports used for the Nth, N+1th, N+2th, and N+3th scans (N: integer) performed by the print head.

Here, for description, the number of the ejection ports formed in the print head according to the present embodiment is 12. The number of the ejection ports 21 used for the printing operation except for the period when the print medium is released from the roller conveying section 9 is 8. Thus, here, two standby ejection ports 16 used only for printing when the print medium is released from the roller conveying section 9 are formed at each of the opposite ends of the ejection port row; a total of four standby ejection ports 16 are formed in the ejection port row. The pitch in the ejection port row is 600 dpi.

When, after the N+2th scan by the print head 3, the upstream end of the print medium, that is, the upstream end in the conveyance direction, passes through the position between the LP roller 7 and the LF pinch roller 8, an error may occur in the conveyance amount of the print medium. At this time, the conveyance amount of the print medium is measured by the detection section 11. The present embodiment uses a non-contact optical position sensor as the detection section 11. The optical position sensor accurately measures the conveyance amount of the print medium when the upstream end thereof passes through the LF roller 7. As shown in FIGS. 2A and 2B, a sensor section of the non-contact optical position sensor is located along the conveyance direction. The length of a detection area of the sensor section along the conveyance direction corresponds to 2,400 dpi, which is at least double the pitch in the ejection port row in the print head.

With reference to FIG. 6, description will be given of the case where the actual conveyance amount detected when the print medium is released from the roller conveying section 9 is about 40 μm smaller than the reference value. Since the conveyance amount of the print medium is smaller than the reference value, when the print head completes the N+3th scan, a print area for one ejection area overlaps the printed area where the printing is finished. If the ejection ports used for the printing at the N+3th scan are similar to those used for the printing at the Nth, N+1th, and N+2th scans, the print area for the one ejection port overlaps the printed area. Thus, the density of this portion becomes higher than that of the remaining area. Consequently, the dense portion appears as a black-stripe like-line in the image. This may degrade the quality of the image resulting from the printing. Furthermore, the actual image resulting from the printing may be shorter in the conveyance direction of the print medium than the image in the print data.

Thus, according to the ink jet printing apparatus according to the present embodiment, the detection section 11 detects the conveyance amount of the print medium so that the range of the active ejection ports can be shifted according to the conveyance amount. Consequently, in the present embodiment, as shown in FIG. 6, the range of the active ejection ports in the print head 3 is shifted to the upstream side by one ejection port.

Specifically, for the printing during the N+3th scan, only one ejection port formed on the downstream side of the two standby ejection ports 16 formed on the upstream side of the print head 3 is used for printing. With respect to one ejection port formed on the most downstream side of the eight ejection ports 21 used for printing except for the period when the print medium is released from the roller conveying section 9, the ejection of droplets is halted. This ejection port is not used for the printing. In this manner, the range of the active ejection ports in the print head 3 is shifted to the upstream side by one ejection port and used for the printing. The area printed by the ejection ports used for the printing during the N+3th scan according to the present embodiment is shown by hatched circles in FIG. 6. As a result, even if the conveyance amount varies during the printing based on the N+3th scan when the print medium is released from between the LF roller 7 and the LF pinch roller 8, the printing is performed while the number of the active ejection ports is maintained at eight. In this case, the portion printed during the preceding printing does not overlap the portion to be printed.

In the embodiment described with reference to FIG. 6, the conveyance amount of the print medium is 40 μm smaller than the predetermined value. However, the actual conveyance amount may be greater than the predetermined value. In this case, the conveyance amount is detected by the detection section 11 so that based on the detected conveyance amount of the print medium, the range of the active ejection ports in the print head 3 is shifted reversely to the downstream side. Specifically, one or both of the two standby ejection ports 16 formed on the downstream side of the print head 3 are used for printing when the print medium is released from the roller conveying section 9 so that the number of the standby ejection ports 16 being active depends on the conveyance amount. For a certain number of the eight ejection ports 21 used for printing except for the period when the print medium is released from the roller conveying section 9, the ejection of droplets is halted so that the number of the inactive ejection ports depends on the conveyance amount. These ejection ports are controlled so as not to be used for the printing.

As described above, according to the ink jet printing apparatus 100 according to the present embodiment, even if the conveyance amount varies when the print medium is released from the roller conveying section 9, the print area can be shifted according to the variation in conveyance amount. Thus, the printing can be performed such that the area printed during the previous scans does not overlap the print area for the next scan. Consequently, an appearance of the black-stripe like-line in the image resulting from the printing is prevented. Furthermore, the print medium is inhibited from being conveyed with an unprinted blank area remaining thereon. Thus, no unprinted area remains on the print medium. Additionally, the image resulting from the printing can be inhibited from being short or long with respect to the conveyance direction of the print medium. Therefore, the quality of the image resulting from the printing can be prevented from being degraded and can be kept high. In this case, the printed area can be prevented from being reduced during the printing. This enables a possible increase in time required for the printing to be inhibited.

Now, the fine-tuning of the position of the print head 3 performed after the shifting of the range of the ejection ports according to the conveyance amount will be described. The position of the print head 3 is fine-tuned using the print head position adjusting section 10 shown in FIGS. 2A and 2B. In the present embodiment, the print head position adjusting section 10 is composed of a piezo element. A voltage applied to the print head position adjusting section 10 varies the distance of the print head 3 relative to the main body section 6. Thus, controlling the voltage applied to the piezo element enables the position of the print head 3 to be adjusted. In STEP 104 or STEP 107, the position of the range of the active ejection ports is adjusted to regulate the print area to some degree. Consequently, in this case, fine-tuning is performed which cannot be dealt with by the adjustment of the position of the range of the ejection ports. Specifically, the print area is adjusted for a deviation in conveyance amount within the range of −0.5 pitches to +0.5 pitches. That is, the predetermined value is set to 0.5 pitches. Then, when the absolute value of the error is at most 0.5 pitches, the shifting of the range of the ejection ports by the active-ejection-port control means is avoided. The print area is then adjusted by moving the print head 3. Here, the size and characteristics of the piezo element are selected so as to allow the print head to be linearly moved.

When the shifting of the range of the active ejection ports and the fine-tuning are completed, the routine is terminated.

In the above-described embodiment, the conveyance amount of the print medium is detected by the detection section 11 every time the print medium is conveyed. When the detected amount exceeds the predetermined value, the corresponding misalignment of the print area is corrected. Thus, the control shown in FIG. 5 is performed every time the print medium is conveyed. However, the present invention may be modified such that the detection section 11 detects the conveyance amount of the print medium only when the upstream end of the print medium is released from between the LF roller 7 and the LF pinch roller 8, a particularly important moment. Only when the upstream end of the print medium is released from between the LF roller 7 and the LF pinch roller 8, the control for correcting the misalignment of the printing area according to the variation in the conveyance amount can be performed.

Figure 8A:
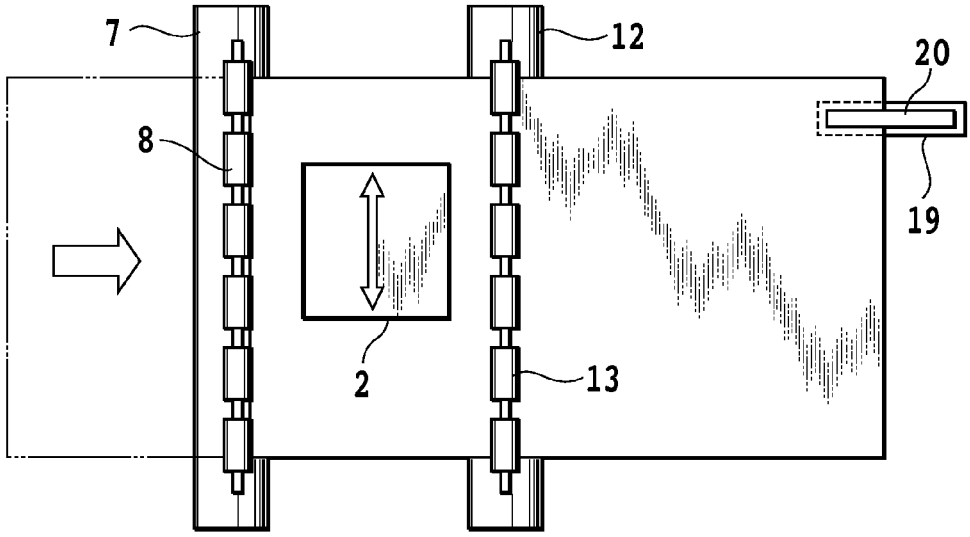
FIG. 8A is a schematic plan view of an ink jet printing apparatus according to yet another embodiment.
Figure 8B:
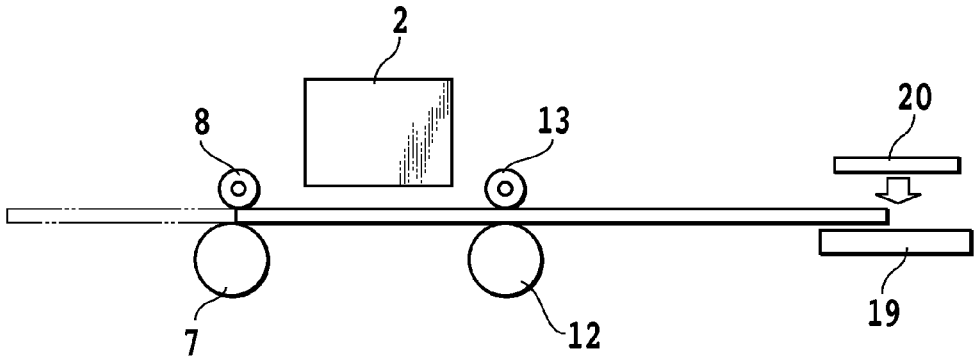
FIG. 8B is a schematic side view of an ink jet printing apparatus according to still another embodiment.

Alternatively, for detecting the conveyance amount at the moment when the upstream end of the print medium is released from between the LF roller 7 and the LF pinch roller 8, such a sensor may be provided as can recognize the position of the upstream end of the print medium. Furthermore, in the above-described embodiment, the detection section 11 is located near the area printed by the print head 3. However, the position of the detection section 11 is not limited to the vicinity of the LF roller 7. The detection section 11 may be positioned so as to detect the downstream end of the print medium in the conveyance direction as shown in FIGS. 8A and 8B.

In the above-described embodiment, two standby ejection ports 16 are formed at each of the opposite ends of the ejection port row 15 in the conveyance direction. Eight ejection ports 21, used for printing except for the period when the print medium is released from the roller conveying section 9, are formed. However, the present invention is not limited to this aspect. The number of the ejection ports may be adjusted according to print conditions. Furthermore, the ratio of the standby ejection ports 16 to the ejection ports 21 used for printing except for the period when the print medium is released from the roller conveying section 9 is also not limited to the above-described embodiment. The ratio may be set according to a predicted variation in conveyance amount.

Figure 7:
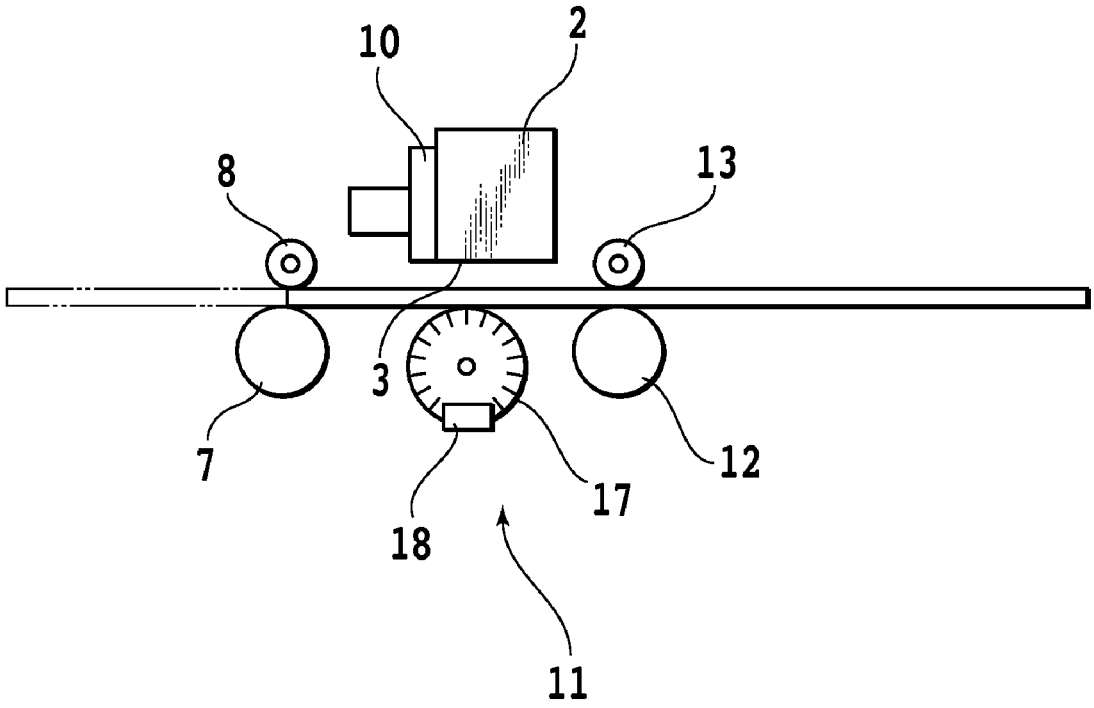
FIG. 7 is a schematic side view of an ink jet printing apparatus according to another embodiment.

The above-described embodiment uses the non-contact optical position sensor as the detection section 11, serving as measurement means for measuring the moving distance of the print medium. However, the present invention is not limited to this aspect. As shown in FIG. 7, the conveyance amount of the print medium may be measured by a combination of an optical sensor 18 and a contact rotary encoder roller 17 that comes into contact with the print medium to measure the moving distance of the print medium, as the detection section 11. Alternatively, a CCD line sensor 19 may be used as shown in FIGS. 8A and 8B. In this case, as shown in FIG. 8B, a light source 20 may be located opposite the CCD line sensor 19 across the print medium so that the CCD line sensor 19 can be irradiated with light to detect the end of the print medium.

In the above-described embodiment, printing is performed by single pass printing. The printing may be performed by multipass printing.

The "printing" as used herein commonly refers to the formation of a variety of images, patterns, or the like on a print medium, or the processing of the print medium. In this case, the "printing" includes not only the formation of significant information such as texts or figures but also the formation of insignificant information regardless of whether or not the information is actualized so as to be visually perceivable.

The "print medium" is not limited to paper, used for common printing apparatuses, but refers to a variety of materials that can receive ink, such as a cloth, a plastic film, a metal sheet, glass, ceramics, wood, and leather.

The "ink" (sometimes referred to as the "liquid") should be broadly interpreted as is the case with the definition of the printing. The "ink" represents a liquid applied to a print medium to form an image, a pattern, or the like thereon or to process the print medium or to process the ink (for example, to solidify or insolubilize a coloring material in the ink applied to the print medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-161758, filed Jun. 20, 2008, which is hereby incorporated by reference herein in its entirety.

What is claimed is:

1. An ink jet printing apparatus for printing on a print medium, comprising:

a print head having a plurality of ejection ports for ejecting ink while scanning in a scan direction;

a conveyance unit including a pair of rollers for conveying the print medium in a conveyance direction crossing the scan direction by rotating the pair of rollers, the pair of rollers being provided at a position on an upstream side in the conveyance direction of the print medium from a print position at which printing by the print head is performed;

a detection unit configured to detect an error in a conveyance of the print medium by detecting a downstream side end of the print medium, wherein the detection unit is disposed at a distance downstream in the conveyance direction from the pair of rollers, such that the detection unit detects the downstream side end of the print medium at a time when an upstream side end, in the conveyance direction, of the print medium is released from the pair of rollers; and a change unit configured to change the ejection ports available for printing according to the error in conveyance detected by the detection unit.

2. An ink jet printing apparatus according to claim 1, wherein the detection unit includes a light source and CCD line sensor.

3. An ink jet printing apparatus for printing on a print medium, comprising:

a print head having a plurality of ejection ports for ejecting ink while scanning in a scan direction;

a conveyance unit including a pair of rollers configured to convey the print medium in a conveyance direction crossing the scan direction by rotating the pair of rollers, the pair of rollers being provided at a position on an upstream side in the conveyance direction of the print medium from a print position at which printing by the print head is performed;

a detection unit configured to detect an error in a conveyance amount of the print medium by detecting a downstream side end of the print medium, wherein the detection unit is disposed at a distance downstream in the conveyance direction from the pair of rollers, such that the detection unit detects the downstream side end of the print medium at a time when an upstream side end, in the conveyance direction, of the print medium is released from the pair of rollers; and a head position adjusting section configured to move the print head in the conveyance direction according to the error in the conveyance amount detected by the detection unit.

4. The printing apparatus according to claim 3, wherein the head position adjusting section includes a piezo element, and a voltage applied to the piezo element is adjusted to enable a distance over which the print head is moved.

5. An ink jet printing apparatus according to claim 2, wherein the detection unit includes a light source and CCD line sensor.

* * * * *